United States Patent [19]

Mizelle

[11] 4,204,474

[45] May 27, 1980

[54] CALORIC INCAPACITATING LOW-LETHALITY PROJECTILE

[76] Inventor: William R. Mizelle, 1330 New Hampshire Ave., NW., Washington, D.C. 20036

[21] Appl. No.: 910,440

[22] Filed: May 30, 1978

Related U.S. Application Data

[63] Continuation-in-part of Ser. No. 767,457, Feb. 10, 1977, Pat. No. 4,091,736.

[51] Int. Cl.[2] ..... F42B 11/36

[52] U.S. Cl. ..... 102/92.7; 102/41; 102/92.6

[58] Field of Search ..... 102/41, 92, 92.6, 92.7; 249/3.1

[56] References Cited

U.S. PATENT DOCUMENTS

| | | | |
|---|---|---|---|
| 3,386,381 | 6/1968 | Ferb | 102/92 |
| 3,417,697 | 12/1968 | Lucy et al. | 102/41 |
| 3,502,025 | 3/1970 | Payne | 102/92 |
| 3,866,537 | 2/1975 | Greenberg | 102/92.7 |
| 4,091,736 | 5/1978 | Mizelle | 102/92.7 |

*Primary Examiner*—Harold Tudor

[57] ABSTRACT

An improved incapacitating projectile to replace the conventional lethal bullet in the corresponding cartridges for various smallarms in general use, notably including police sidearms. In this projectile, propelled by a conventional smallarms powder charge, a suitable volume of propellant powdergas is admitted upon firing to a chamber inside the projectile, and is transmitted retained within the projectile chamber to the target. As target impact retards the projectile body, a piston in this chamber travels forward, impelled by its own momentum, ejecting this hot powdergas—further re-heated by compression and friction—through a "pinhole" aperture in the projectile's nose, upon its human or animal target.

Because this arrangement incapacitates instantly by inflicting an intolerably acute localized burn, the projectile body may be made of material of mass low enough to prevent or minimize the possiblity of a serious penetrating or blunt-trauma wound. If the projectile body is of such low-mass material, the rapid decay of bullet energy downrange in the event of a miss obviates virtually all risk of its inflicting painful, much less lethal or serious, injury upon bystanders.

9 Claims, 7 Drawing Figures

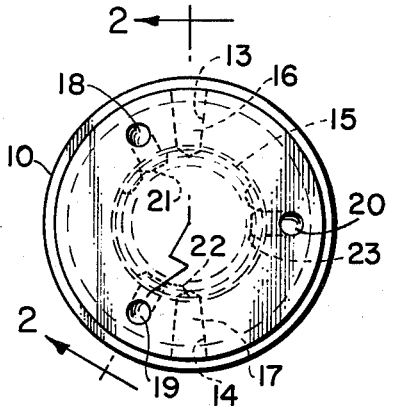
FIG. 1
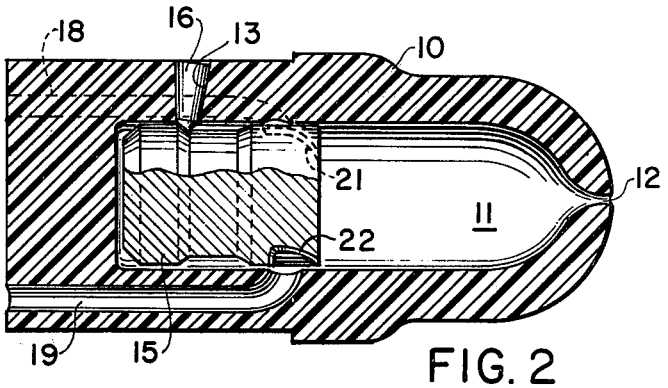
FIG. 2
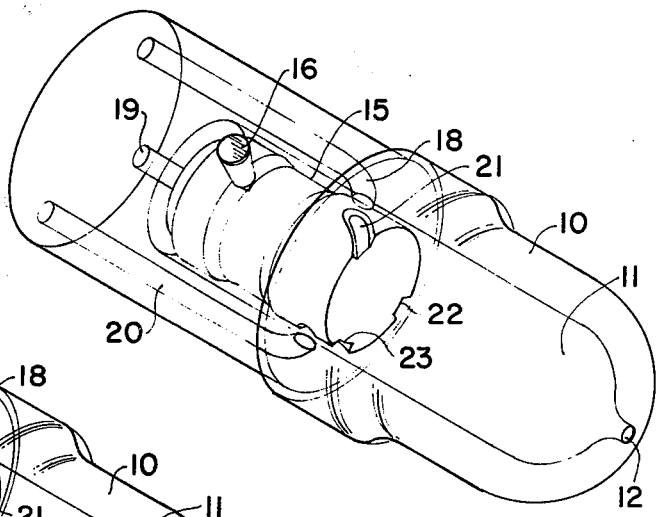
FIG. 3
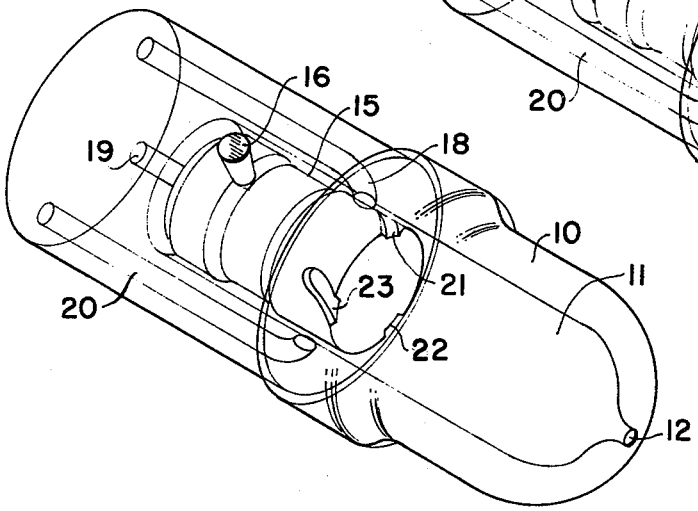
FIG. 4
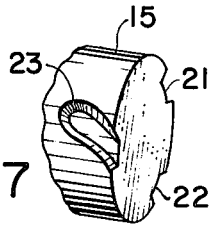
FIG. 7
FIG. 5
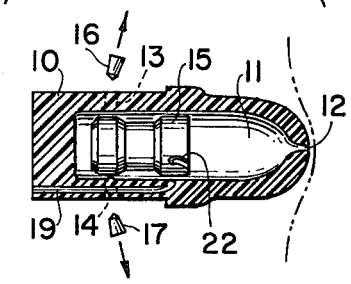
FIG. 6
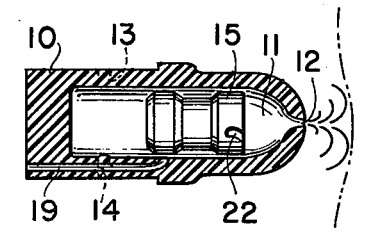

CALORIC INCAPACITATING LOW-LETHALITY PROJECTILE

BACKGROUND OF THE INVENTION

The present invention is a continuation in part of the structure disclosed by the same inventor in application Ser. No. 767,457, filed Feb. 10, 1977, now U.S. Pat. No. 4,091,736.

The background and objects of the present disclosure are substantially the same as those set forth in that application and patent. The present improvement permits extension of the intended range within which the projectile will incapacitate a human being. Also, by broadening the limiting parameters in the projectile's design, the present improvement facilitates the disclosed system's use in incapacitating projectiles for a wider variety of calibers and patterns of ammunition and corresponding unmodified smallarms.

Retaining low lethality, the present improvement also provides even greater design latitude than does the projectile structure of U.S. Pat. No. 4,091,736—more design margin to assure incapacitating effect while permitting the reduction of projectile total mass and weight to values that prevent the possibility of a serious penetrating or blunt-trauma wound.

As set forth in the previous application and patent's objects, the munitions art has long sought to devise a projectile or missile of minimum lethality which will immediately incapacitate a human being, primarily for law-enforcement use. The more society and the law have stressed the need to keep the peace and protect the public with minimum necessary force, the more police officers have hesitated to shoot, often with results fatal to themselves.

Air piracy in recent years has made the need for an instantly incapacitating alternative to conventional gunfire even more urgent. Air marshals aboard airliners at high altitudes have been helpless, lacking handgun ammunition capable of subduing the hijackers of passenger aircraft without prohibitive risk of perforating the hull or a window and causing catastrophic decompression of the pressurized aircraft.

As noted in the previous application and patent cited, outside the law-enforcement field, as householders and shopkeepers have increasingly looked to personal firearms for protection against rising violent crime, gun accidents and impulse shootings have added to the national gunshot toll.

As was also noted, since the only generally accepted reason for firing a deadly bullet at anyone is to deter him in the act of threatening deadly harm, humane hesitance to fire has permitted violent suspects to escape. More felons have escaped when police officers could not fire because of the danger to bystanders, nearby or at a distance.

Police forces still need and want an incapacitating alternative to deadly gunfire, as was noted. For in the bulk of the many proposed alternatives to date, law-enforcement users have noted drawbacks. Examples:

Gun-fired tranquillizer darts or projectiles, in practice, have lacked a drug or drugs quick enough in taking effect upon a human target. Aside from this drawback, one man's lethal dose of most such agents would fail to subdue another. Moreover, liquid contained in a gun-fired projectile behaves hydraulically, and transmits excessive forces radially to the projectile's walls and to the bore of the gun.

These darts also share other drawbacks, police equipment specialists observe, with various gun-fired projectiles developed in the search.

Most of these must be larger and longer than a regular bullet, which would require the user to carry a second, separate launcher gun, and to decide—typically in split-seconds—which to draw and use. Generally, these require reloading after every shot, have very limited accurate range, and/or are ineffective unless they strike the head, which is too small a target.

The most frequent law-enforcement objection to proposed alternatives to the conventional bullet is that they offer insufficient certain latitude between risk of serious injury and failure to incapacitate.

Finally, as noted in the referenced previous application and invention, typical of most gun-fired low-lethality incapacitating projectiles proposed to date is a complexity of structure that invites malfunctions in "street use", police specialists feel. This complexity also entails relatively high cost of manufacture, which would price them out of the reach of the typically tightly-budgeted police department.

SUMMARY OF THE INVENTION

This invention relates generally to the munitions art, but more particularly to a projectile which will impinge upon the person struck an incapacitatingly hot jet or puff of propellant powdergas transmitted by the projectile. Its structure and function adapt the projectile body to being made of material sufficiently light in weight and mass (such as but not necessarily confined to solid nylon) so that it shall be unlikely to inflict a serious penetrating or blunt-trauma wound such as is characteristic of a metallic bullet.

The primary object of this invention is to provide a projectile capable of subduing or deterring a violent individual. To this end, the projectile, when fired by a conventional smallarms propellant charge, admits a suitable volume of this propellant powdergas to a chamber provided within the projectile body. The rush of powdergas into the projectile chamber, through passages in the projectile body communicating with channels in the head of a piston contained in the projectile chamber, rotates this piston enough to take these channels out of register with the powdergas passages.

The hot powdergas is thus prevented from escaping to the rear during bullet flight. During bullet flight, a small amount of the contained powdergas will vent forward through a "pinhole" aperture open to the atmosphere, but enough hot gas will remain within the projectile chamber to achieve the object.

Upon impact, the bullet projects through said pinhole aperture the contained powdergas, still hot, against the target. The needle-fine jet of powdergas, ejected at bullet-impact velocity, is likely to penetrate the skin and superficial tissues of the human target. Thus, even though the projectile rebounds, the full caloric energy of the jet of powdergas will do its work within the skin and tissues of the person struck.

A related object is to incapacitate as quickly and positively, or more so, than does a wound by a common bullet. A common bullet, although it may have inflicted a lethal wound, may not immediately deter a determined individual, as will the acute "sting" caused by this invention.

A further object of this invention is to provide a projectile which has such capability if constructed in a size and form to fit smallarms cartridge cases in general use, and to function in the actions of, and when fired by, the corresponding smallarms in general use, unmodified.

Another object of this invention is to provide such a projectile which is as accurate as the conventional bullet at selected reduced ranges characteristic of anti-crime "shooting situations". A related object, if such a projectile is made of suitable low-mass material, is that it shall be virtually harmless to anyone beyond the reduced range of its intended target.

A further object is to provide an incapacitating smallarms projectile effective if of such low-mass material that it will not penetrate the hull or window of a pressurized aircraft in an air piracy situation.

A further object is to provide a gun-fired projectile that will deter the attack or intrusion of a domestic or wild animal which it is not desired to destroy or injure.

Other objects and advantages will become apparent from the following description of the invention's function, which refers to the accompanying drawing figures.

BRIEF DESCRIPTION OF THE DRAWINGS

FIG. 1 is a rear view of a preferred embodiment of the projectile disclosed, showing powdergas passages 18, 19 and 20, which conduct powdergas upon firing, through projectile body 10. Arrows indicate the portion of the structure cut away in FIG. 2.

FIG. 2 is a longitudinal section, showing projectile body 10, incorporating internal chamber 11, wherein slidable piston 15 is retained in its rear position by retainer plugs 16 (shown) and 17 (not visible), seated in retainer plug holes 13 (shown) and 14 (not visible). Visible in this figure is the manner in which powdergas passages (18 and 19 shown) communicate into corresponding channels (21 and 22 shown) in the side of the head of piston 15.

FIG. 3 is a perspective, as if transparent, showing how powdergas passages 18, 19 and 20 communicate with channels 21, 22 and 23.

FIG. 4 is a perspective, as if transparent, showing how the rush of powdergas via passages 18, 19 and 20 through channels 21, 22 and 23, due to their helical curvature, rotates piston 15 so as to prevent rearward escape from chamber 11 of the contained powdergas during bullet flight.

FIG. 5 represents a longitudinal cross-section, showing the projectile as it strikes.

FIG. 6 represents a longitudinal cross-section, showing the projectile as it impinges intensely hot powdergas upon the surface of its target and rebounds.

FIG. 7 better shows the shape and placement of channels 21, 22 and 23 around the head portion of piston 15.

DESCRIPTION OF THE DRAWINGS OF A PREFERRED EMBODIMENT

FIG. 1 is a rear view of an exemplary projectile having the structure of the subject invention. In the projectile body 10, an uneven number of powdergas passages 18, 19 and 20 conduct a suitable volume of hot powdergas upon cartridge firing forward through projectile body 10.

FIG. 2, a side view cut away at the section indicated in FIG. 1, shows how powdergas passages (18 and 19 visible) conduct a portion of the powdergas of firing through a matching uneven number of channels (21 and 22 shown) cut into the sides of the head of closely-fitting slidable piston 15. As may be seen, this permits powdergas to enter projectile chamber 11, where it displaces air naturally present therein through the pinhole aperture 12 in the nose of projectile body 10. Also in this figure, one of two piston retainer plugs (16 shown), press-fitted in piston retainer plug holes (13 shown), retain piston 15 rotatably in its rearmost position, as is the case throughout cartridge handling, firing and projectile flight.

FIG. 3, a perspective as if transparent, shows how powdergas passages 18, 19 and 20 align with channels 21, 22 and 23 until and during cartridge firing. Here it may be seen that channels 21, 22 and 23 are curved or cupped in the manner of turbine blades, to the effect shown in FIG. 4.

FIG. 4, a perspective as if transparent, shows how the rush of powdergas into projectile chamber 11 has rotated piston 15 sufficiently to displace the channels 21, 22 and 23, impeding rearward escape of powdergas from projectile chamber 11 during bullet flight to target.

FIG. 5, a longitudinal cross-section, illustrates the expulsion of the piston retainer plugs 16 and 17 as target impact retards the projectile, causing piston 15's momentum to overcome its retention. As will be seen, the area of the base of piston 15 upon which retainer plugs 16 and 17 bear is beveled at a suitable angle for the "set-forward" of piston 15 to accomplish this.

In FIG. 6, the same cross-section, impact with the target has stopped the projectile body 10, while the piston 15 continues to be hurled forward by its momentum, expelling the contained hot powdergas through pinhole aperture 12 upon the target. Compression by piston 15, and the friction of expulsion through aperture 12, further heats the powdergas impinged upon the target.

FIG. 7, a perspective of the head of piston 15, provides another view of channels 21, 22 and 23.

It will be apparent that the embodiment illustrated is calculated to fulfill the above-stated objects of the invention, and it will be appreciated that the subject invention is susceptible to modification, variation and change without departing from its scope as stated herein.

I claim:

1. A low-lethality projectile whereby a human or animal target within a selected range is incapacitated, notwithstanding the projectile's having a weight and mass light enough to make it unlikely to inflict a serious penetrating or blunt-trauma wound, having in a chamber of suitable form within the projectile means for admitting and trapping a portion of the hot powdergas of cartridge firing; and means for impinging said contained hot powdergas upon the intended target.

2. The projectile of claim 1, wherein the leading edge or portion of the projectile—that striking the target—has a comparatively restricted or minute orifice communicating from said chamber to the atmosphere.

3. The projectile of claim 1, wherein said means for trapping a portion of the hot powdergas includes a piston slidable in said chamber.

4. The projectile of claim 3, wherein the piston is by suitable means retained in its rearmost position in the projectile chamber before and during firing and projectile flight, said piston also being rotated in its seat by the rush of powdergas into the projectile chamber, so as to impede the escape of contained hot powdergas to the rear during projectile flight.

5. The projectile of claim 4, wherein said piston retaining means is overcome by the impact of the projectile upon its target, allowing said piston to travel forward in relation to the projectile body and impelled by the piston's own momentum.

6. The projectile of claim 4, wherein said retaining means comprises a plurality of retainer plugs bearing upon a surface of the piston so shaped that the retainer plugs are unseated and expelled to free the piston by the "set-forward" of projectile target impact.

7. The projectile of claim 3, wherein said portion of the powdergas of firing is admitted to said projectile chamber by a passage or passages communicating from the projectile base through the projectile body, to and via a corresponding channel or channels in said piston, and thence into the projectile chamber.

8. The projectile of claim 5, wherein the piston's forward travel in relation to the projectile body upon target impact expels hot powdergas through said aperture upon and/or into the surface of the target.

9. The projectile of claim 8, wherein the projectile body's material, properties and dimensions are adaptable to its operation as a cartridge component in the actions of, and for firing by, various unmodified small-arms in general use.

* * * * *